US006175584B1

(12) United States Patent
Pavlicevic et al.

(10) Patent No.: US 6,175,584 B1
(45) Date of Patent: Jan. 16, 2001

(54) ASPIRATION SYSTEM TO REDUCE THE LOSSES OF FINE MATERIALS AND POWDERS FROM AN ELECTRIC ARC FURNACE

(75) Inventors: Milorad Pavlicevic, Udine (IT); Peter Tishchenko, Donezk (UA); Alfredo Poloni, Fogliano di Redipuglia; Angelico Della Negra, Povoletto, both of (IT)

(73) Assignee: Danieli & C. Officine Meccaniche SpA, Buttrio (IT)

( * ) Notice: Under 35 U.S.C. 154(b), the term of this patent shall be extended for 0 days.

(21) Appl. No.: 09/482,949

(22) Filed: Jan. 14, 2000

(30) Foreign Application Priority Data

Feb. 10, 1999 (IT) ..... UD99A0015

(51) Int. Cl.[7] ..... F27D 17/00
(52) U.S. Cl. ..... 373/9; 373/2; 373/8; 266/158
(58) Field of Search ..... 373/2, 8, 9, 71, 373/73, 74, 77, 79, 80, 110, 115, 116; 266/45, 46, 158

(56) References Cited

U.S. PATENT DOCUMENTS

| | | | | |
|---|---|---|---|---|
| 3,721,743 | * | 3/1973 | Shiina et al. | 373/9 |
| 4,526,678 | * | 7/1985 | Myhren et al. | 373/9 |
| 4,634,104 | * | 1/1987 | Wamser | 373/9 |
| 4,720,837 | * | 1/1988 | Kanada | 373/9 |
| 5,787,108 | * | 7/1998 | Pavlicevic et al. | 373/9 |

FOREIGN PATENT DOCUMENTS

| | | |
|---|---|---|
| 3147337 | 6/1983 | (DE) . |
| 3602498 | 8/1986 | (DE) . |
| 19729317 | 1/1999 | (DE) . |
| 0805327 | 11/1997 | (EP) . |
| 0807793 | 11/1997 | (EP) . |

* cited by examiner

*Primary Examiner*—Tu Ba Hoang
(74) *Attorney, Agent, or Firm*—Stevens, Davis, Miller & Mosher, LLP

(57) ABSTRACT

Aspiration system to reduce the losses of fine materials and powders from an electric arc furnace having a lower hearth suitable to contain the bath of metal material being melted, a substantially cylindrical chamber arranged above the hearth, at least one electrode arranged in a central zone of the chamber and a roof arranged to cover the chamber and provided with at least one aperture through which the fumes produced by the bath can exit, the system comprising a first aspiration sub-system arranged inside the chamber and at least another discharge sub-system arranged in correspondence with the roof, the first aspiration sub-system comprising a coil of cooling pipes arranged helical so as to define, in a vertical direction, empty zones between the spirals of pipes, the coil of cooling pipes being distanced from the cylindrical wall of the chamber to define a peripheral interspace through which the fumes can ascend towards the roof according to at least an ascensional, rotatory vortex.

22 Claims, 3 Drawing Sheets

ASPIRATION SYSTEM TO REDUCE THE LOSSES OF FINE MATERIALS AND POWDERS FROM AN ELECTRIC ARC FURNACE

FIELD OF THE INVENTION

This invention concerns an aspiration system to reduce losses of fine materials and powders in an electric arc furnace (EAF) used in steel works to melt ferrous materials or other metals.

To be more exact, the invention refers to a system to aspirate the fumes produced during the melting process and convey them towards the outside, the system being suitable to be used both in furnaces with electrodes fed on direct current (DC) and on alternating current (AC).

BACKGROUND OF THE INVENTION

The state of the art includes various aspiration and plugging systems for melting volumes, performed by means of adjacent cooling pipes through which water flows, or by means of walls formed by sheet metal cooled by sprayed water, or again by means of refractory materials able to resist high temperatures.

The gases produced during the melting process are aspirated by means of a pipe and an aperture made in the roof of the furnace itself, commonly known as the fourth hole.

In existing systems, it has been noticed that with the direct aspiration of the fumes huge quantities of solid particles are transported into the plant; these particles increase the consumption of electric energy of the auxiliary equipment, such as the fans, used for the aspiration of the particles, and limit the duration of the filters through which the fumes pass. Above all, since a large part of the particles transported by the fumes consists of metallic material, this also reduces the productivity of the furnace. In addition, when the material loaded is fine material, such as for example DRI (directly reduced iron) or IC (iron carbide, or material obtained from the reduction of iron material containing a high percentage of $Fe_3C$), the yields are further diminished.

SUMMARY OF THE INVENTION

The present invention relates to an aspiration system to reduce the losses of fine materials and powders from an electric arc furnace One purpose of the invention is to achieve an innovative aspiration system which will efficiently and drastically reduce the losses of fine materials loaded into an electric furnace.

In accordance with this purpose, the aspiration system according to the invention substantially consists of three sub-systems cooperating with each other: a sub-horizontal aspiration sub-system, one to collect the fumes and a cyclone sub-system to discharge the fumes.

The sub-horizontal aspiration sub-system is connected with the discharge sub-system by means of the collection sub-system.

The movement of the fumes generated in the bath of liquid material is prevalently horizontal. Moreover the fumes possess a strong component of vertical ascensional movement, caused by their high temperature.

In this type of movement, which is substantially curved, the fumes are partly separated from the solid suspended particles due to the effect of the different density and the action of the centrifugal force.

Moreover, since the fumes pass through a grid of cooling pipes arranged in a coil inside the central chamber of the hearth, a natural filtering action occurs.

The solid particles impact on the pipes and fall back into the melting volume or adhere to the pipes on their outer surface.

The interaxis between the pipes is sized in a suitable manner in order to prevent there being any blockage of the empty spaces between the pipes. Experience has shown that a film of transported material, mostly consisting of oxides, is deposited on the pipes, protecting them from the peaks of heat flow and increasing their duration.

When the heat flow imposed by the working conditions of the furnace becomes high, part of the deposited film liquefies, and thus diminishes the apparent heat flow extracted from the water.

The interaxis between the pipes is also sized so that the fumes have an adequate local speed in the interspace between the side wall of the furnace and the pipes themselves, to prevent any solid material from being blocked between the said pipes.

On the contrary, the speed of the fumes in the empty spaces between the pipes depends on the total aspiration section, which in the system according to the invention is much greater than the conventional section found in a usual furnace. Therefore, the transportation of the solid particles is per se reduced, since the speed is lower and since the quantity of particles transported by the fumes is directly proportionate to the speed of the fumes.

The distance between the cooling pipes and the side wall of the furnace is sized in such a way as to allow a suitable, balancing ascensional speed of the fumes. Therefore, the ascensional speed is variable from position to position, and changes both on the sections of height, because the volume of gases increases, and also on the azimuth sections, in order to balance the aspiration.

The fumes collected in the interspace between the inner wall of the cooling pipes, which are not dense, and the outer wall of the furnace, possibly consisting of other adjacent cooled pipes or of sheet metal cooled by sprayed water or another plugging element, are then aspirated upwards and circumferentially towards the area of discharge.

The resulting movement is therefore of the helical type with a prevalently vertical component and a tangential component. This movement can be managed by means of an appropriate sizing of the sections of the interspace.

The helical movement of the fumes entails a further filtering of the fumes from the suspended particles due to the cyclone effect.

The particles fall downwards where they are re-melted and re-enter the bath.

The collection sub-system is a cyclone proper. It has the double function of transforming the helical movement into a tangential one, with a consequent further filtering, and of aspirating the residual fumes from the region of the roof of the furnace.

Finally, the discharge sub-system is achieved by means of a cooled cylinder which is able to induce a helical movement in the inner volume: in fact, it aspirates from the bottom and is connected tangentially with the discharge aperture of the fumes.

The fumes pass from below through a cooled grid and are further filtered. The solid particles fall back at this point into the melting volume.

Another purpose of the invention is to achieve an aspiration system for an electric arc furnace wherein the fumes are rapidly cooled already inside the furnace and are conveyed towards the roof in such a way that the particulate cools sufficiently to make it re-acquire consistency, through coalescence, so as to make it precipitate into the underlying bath of melted metal, preventing it from exiting afterwards through the chimney and dispersing into the atmosphere.

Another purpose of the invention is to achieve an aspiration system which will allow to use pre-reduced metal material in the furnace, in pellets of around 15–20 mm in diameter, with very small particles which therefore do not participate in the formation of the molten metal but which remain suspended in the fumes.

Another purpose of the invention is to achieve an aspiration system which will prevent the formation of a substantially static cloud of particulate around the electrodes of the furnace; this cloud would encourage the dissipation of energy towards the walls of the central chamber and the roof, with a consequent rapid wear of the said walls and of the insulating component arranged around each electrode.

Another purpose of the invention is to achieve an aspiration system which will reduce the passage of gas and air on the surface of the electrodes, limiting their consumption through oxidation.

Another purpose of the invention is to achieve an aspiration system which will be valid for furnaces fed on direct current and also those fed on alternating current.

BRIEF DESCRIPTION OF THE DRAWINGS

These and other characteristics of the invention will become clear from the following description of a preferred embodiment, given as a non-restrictive example, with the help of the attached drawings wherein.

DETAILED DESCRIPTION OF A PREFERRED EMBODIMENT

Figure 1:
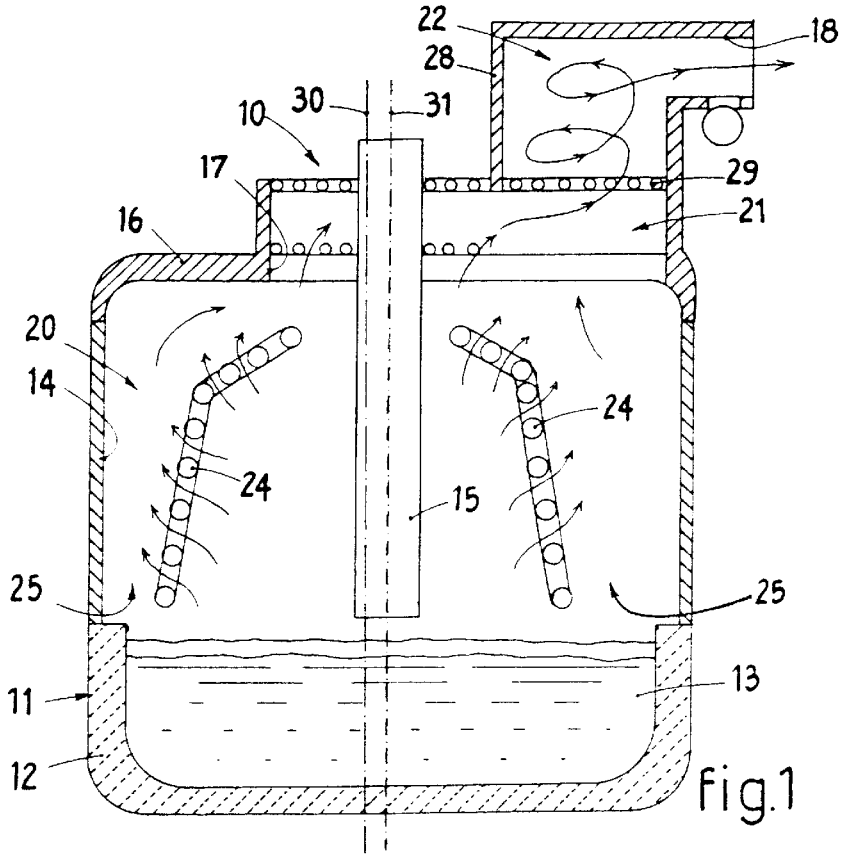
FIG. 1 is a longitudinal section in diagram form of an electric arc furnace adopting an aspiration system according to the invention.
Figure 2:
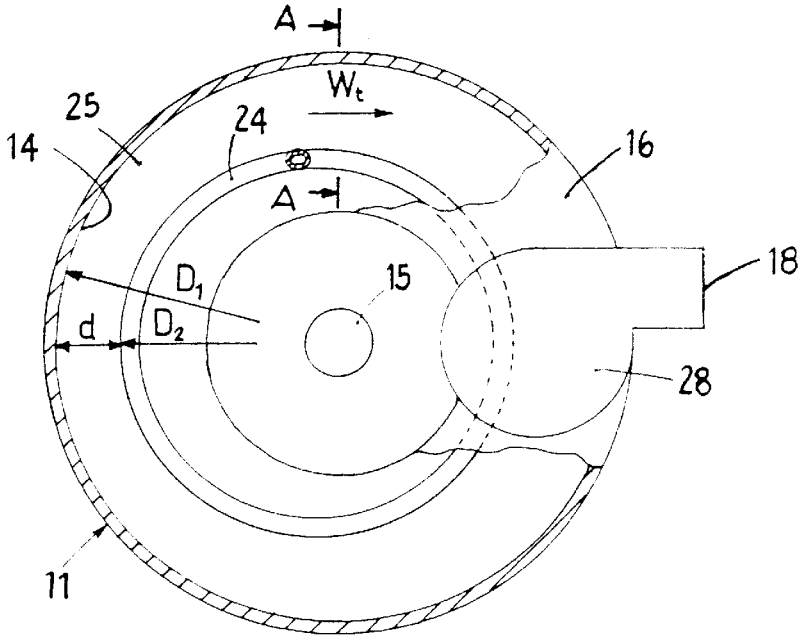
FIG. 2 is a schematic view from above of the furnace shown in FIG. 1.
Figure 3:
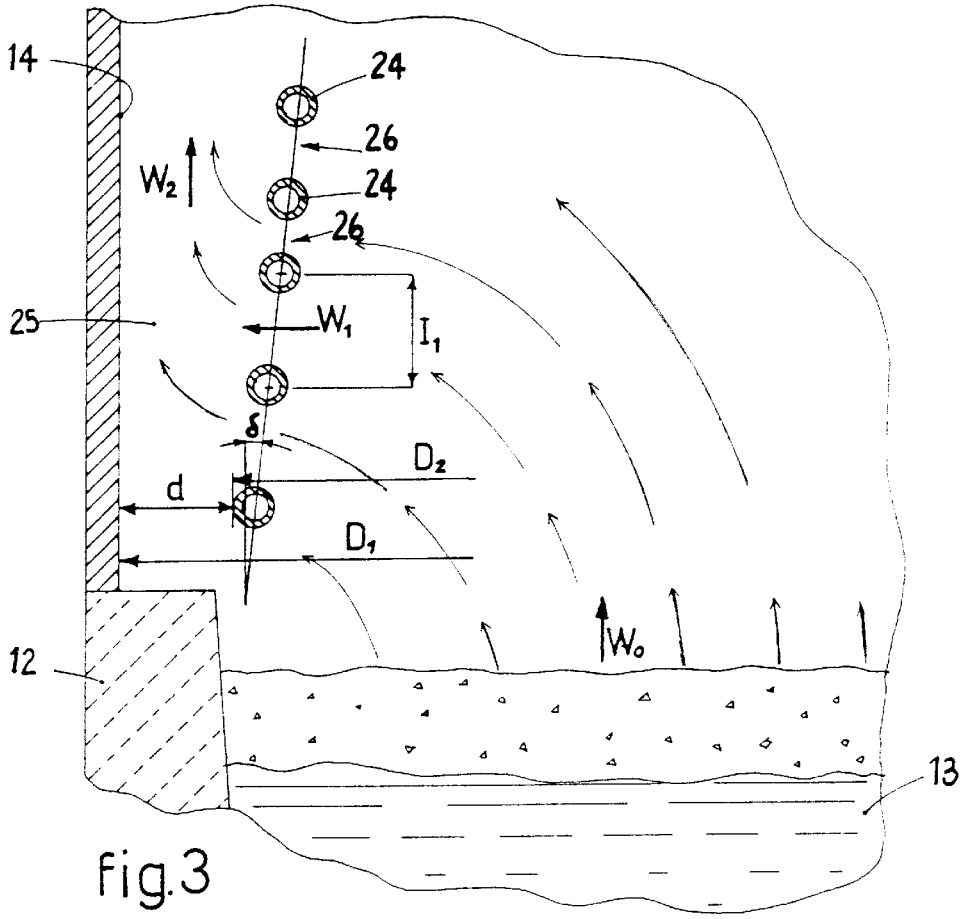
FIG. 3 is a detail of the aspiration system according to the invention shown in diagram form.
Figure 4:
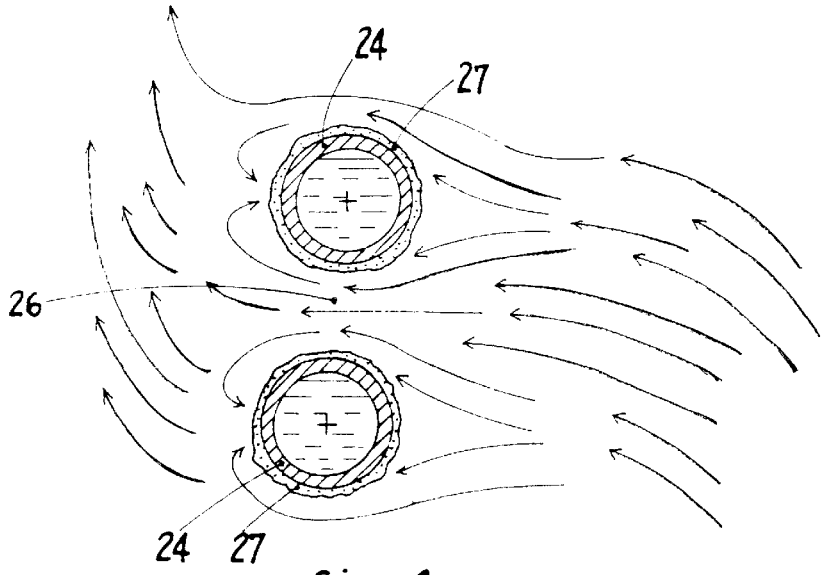
FIG. 4 is an enlarged detail of FIG. 3.

FIG. 1 shows an aspiration system 10 according to the invention applied in an electric arc furnace 11 of the type comprising a lower hearth 12 made of refractory material, which contains the bath 13 of melting metal, a central chamber 14, substantially cylindrical in shape, located above the hearth 12 and suitable to house one or more electrodes 15, which can be of the type fed either on direct current (DC) or on alternating current (AC).

A roof 16 covers the central chamber 14 and is provided with a central aperture 17 through which the electrode or electrodes 15 can be selectively inserted into or removed from the central chamber 14, and with another aperture 18, more peripheral, commonly called the fourth hole, through which the fumes produced by the melting metal 13 in the hearth 12 can exit from the furnace 11 towards the chimney of a known type and not shown in the drawings.

The furnace 11 is suitable to be loaded with iron scrap or other, alternative metal materials, such as for example prereduced iron in the form of pellets of a size usually between about 15 and 25 mm.

However, the aspiration system 10 also allows to load and melt, with good yields, very fine materials, with a diameter typically less than a millimetre and in the range of between 200 and 300 $\mu$m, with the advantage of saving costly pre-processing operations to compact the fine materials into units of greater diameter.

The aspiration system 10 comprises three sub-systems arranged substantially one above the other: a first sub-horizontal aspiration sub-system 20, arranged in the central chamber 14; a second sub-system for the collection of the fumes 21, arranged in correspondence with the roof 16; and a third cyclone sub-system 22 to discharge the fumes, arranged in correspondence with the aperture 18.

The sub-horizontal aspiration sub-system 20 comprises a coil of cooling pipes 24 (FIGS. 1–4) arranged in the chamber 24, inside which a cooling fluid, for example water, is made to circulate under pressure.

The coil of pipes 24 is arranged in a cylindrical helical shape with a vertical axis 30 off-set from the vertical axis 31 of the chamber 14, so that it is asymmetrically distanced from the cylindrical wall of the chamber 14 and defines an interspace 25 with a variable width.

Moreover, the pipes 24 are arranged in a truncated cone, with the tapered part facing upwards, so that the interspace 25 is narrower towards the hearth 12 and wider towards the roof 16. The angle $\delta$ of the taper of the pipes 24 is about 5–10° . However, in a non-optimum embodiment but which is easier to achieve, the taper $\delta$ may even be zero.

The minimum width "d" of the interspace 25 is a function of the inner diameter $D_1$ of the chamber 14 and of the outer diameter $D_2$ of the bundle of pipes 24 arranged in a spiral. Careful studies and practical testing have shown that the optimum ratio between the diameters $D_1$ and $D_2$ is about $D_1$=1.1–1.6 times $D_2$.

The pipes 24 may be arranged in a single coil which describes the whole spiral, from the bottom upwards, or vice versa, or in superimposed rings, or in panels or independent sections, of the type with a cylindrical sector or otherwise, the panels/sections being contiguous with each other so as to form, in any case, a cooling wall substantially cylindrical or shaped like a truncated cone.

According to one characteristic of the invention, the pitch of the spiral, with relation to the diameter of the pipes 24, is such that, in a vertical direction, between one spiral of pipes and the other or between adjacent pipes 24 there are empty zones or spaces 26 which allow the horizontal, or substantially horizontal, passage of the fumes from the center of the chamber 14 (where they are generated by the melting process) towards the peripheral interspace 25. Optimum results have been obtained with distances $I_1$ between the pipes 24 of between 70 and 120 mm, which allow the fumes to pass at a speed of $W_1$ of between about 1 and 15 metres per second.

In practice, when the furnace 11 is working normally, the size of the zones 26 is reduced due to the deposit of melting slag 27 on the outer walls of the pipes 24. This slag consists mainly of oxides which, transported by the fumes, adhere to the cold surface of the pipe. The thickness stabilises after an adequate number of castings, and reaches a balance of around 2–5 mm. The deposits carry out a protective action on the pipes 24, and reduce the heat load thereon, since they have low heat conductivity. During the hottest steps of the furnace, for example during the refining step, part of the slag may melt, and thus operates as a heat reserve. The result is also that there is a reduced energy consumption compared with conventional embodiments.

The ascensional speed of the fumes $W_0$ is inversely proportional to the total aspiration section. Therefore, in the case shown here, it is much less than that of traditional systems, where the aspiration section is that of the fourth hole. Since the metal particles are transported by the gas, the quantity removed from the furnace is proportional to $W_0$ squared (kinetic gas energy). Therefore, in the embodiment according to the invention, the incidence of the particulate removed from the melting volume is diminished per se.

In fact, the quantity of particles transported by the fumes is directly proportional to the ascensional speed of the fumes $W_0$.

The distance "d" and the inclination δ of the taper of the pipes 24 are sized in such a way as to obtain a suitable and balanced speed $W_2$ of the fumes. The speed $W_2$ is variable from position to position and changes both in the sections of height (FIG. 5), because the volume of the gases increases, and also in the azimuth sections, in order to balance the aspiration.

Thanks to the particular spiral arrangement of the pipes 24, the zones 26 and the interspace 25, the fumes inside the chamber 14, instead of rising vertically, ascend in a rotational movement, with an azimuth rotatory component, in the form of a vortex or cyclone, with indubitable benefits for the duration of the electrode or electrodes 15, the wall of the chamber 14 and the roof 16.

Figure 5:
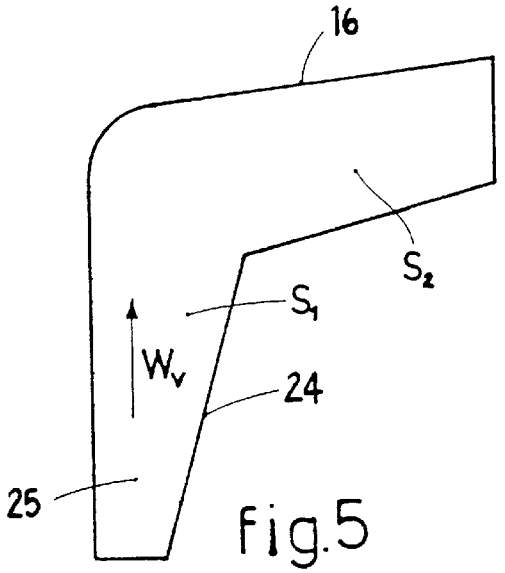
FIG. 5 is a section from A to A of FIG. 2.

The fumes collected in the interspace 25 between the wall of pipes 24 and the outer cylindrical wall of the chamber 14 are then aspirated upwards and circumferentially towards the discharge zone. The resultant movement is helical with a prevalently vertical component $W_v$ and a tangential component $W_t$. This movement can be pre-determined by means of the appropriate sizing of the sections $S_1$ and $S_2$ (FIG. 5).

Figure 6:
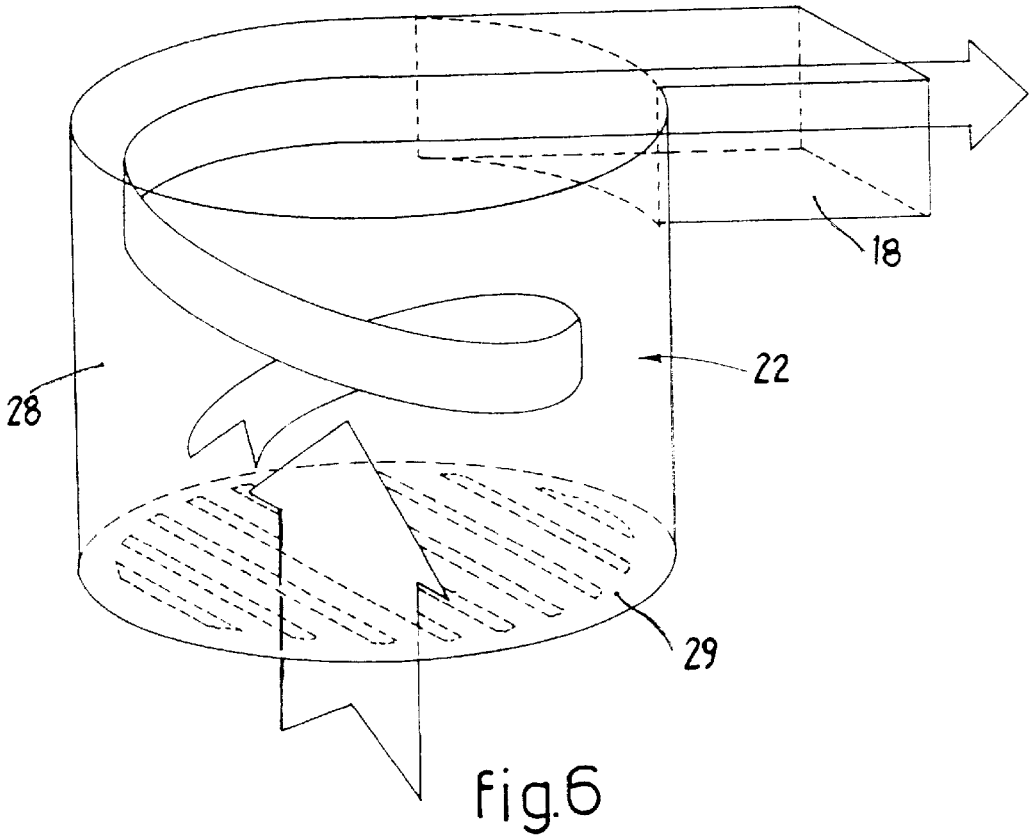
FIG. 6 is a prospective, schematic view of another detail of the aspiration system according to the invention.

The cyclone discharge sub-system 22 (FIGS. 1, 2 and 6) is achieved by means of an upper cylinder 28 arranged on the upper part of the roof 16, in a position peripheral and off-set with respect to the axis 31 of the chamber 14; the walls are equipped with cooling means of a known type which are not shown in the drawings. The cylinder 28 is connected tangentially with the aperture 18 to discharge the fumes and is able to induce a helical movement in the inner volume, therefore the fumes are aspirated from the bottom. A grid 29, also cooled by the circulation of cooling fluid inside, is arranged in the lower part of the cylinder 28. It carries out a further direct filtering of the fumes which pass through it, and causes also the residual solid particles collected at the base of the cyclone 28 to fall into the underlying bath 13.

It is obvious that modifications and additions may be made to the aspiration system for an electric arc furnace as described heretofore, but these shall remain within the field and scope of the invention.

What is claimed is:

1. A system to reduce the losses of fine materials and powders from an electric arc furnace having a lower hearth suitable to contain a bath of metal material being melted, a substantially cylindrical chamber arranged above the hearth, at least one electrode arranged in a central zone of the chamber and a roof arranged to cover the chamber and provided with at least one aperture through which the fumes produced by the bath can exit, comprising said cylindrical chamber, said roof, and an aspiration system comprising:

a first aspiration sub-system arranged inside the chamber, and at least another discharge sub-system arranged in correspondence with the roof, and wherein the first aspiration sub-system comprises a coil of cooling pipes arranged helically to have spirals so as to define, in a vertical direction, empty zones between the spirals of pipes, the coil of cooling pipes being sized to be distanced from the cylindrical wall of the chamber to define a peripheral interspace between the coil and the cylindrical wall of the chamber through which the fumes can ascend towards the roof according to at least an ascensional, rotatory vortex.

2. The system as in claim 1, wherein the coil of pipes is arranged offset with respect to the chamber, so that the width of the peripheral interspace is variable in a radial direction.

3. The system as in claim 1, wherein the coil of pipes is arranged substantially in a truncated cone, with the tapered part facing upwards, so that the width of the peripheral interspace is variable in a horizontal direction.

4. The system as in claim 3, wherein the angle (5) of taper of the coil of pipes is about 5–10°.

5. The system as in claim 1, wherein the empty zones allow the horizontal or substantially horizontal passage of the fumes from the center of the central chamber towards the peripheral interspace.

6. The system as in claim 5, wherein the distance in a vertical direction between the pipes inside the central chamber is between 70 and 120 mm, to allow the fumes to pass at a speed ($W_1$) of between about 1 and 15 meters per second.

7. The system as in claim 1, wherein the width of the interspace is a function of the inner diameter ($D_1$) of the chamber and of the outer diameter ($D_2$) of the coil of pipes and wherein the ratio between the inner diameter ($D_1$) and the outer diameter ($D_2$) is between about 1.1 and 1.6 ($D_1$=1.1–1.6×$D_2$).

8. The system as in claim 1, wherein the other discharge sub-system comprises an upper cylinder arranged on the upper part of the roof, in a peripheral position, and connected tangentially with the aperture to induce a helical movement in the inner volume.

9. The system as in claim 8, wherein the upper cylinder has walls provided with cooling means.

10. The system as in claim 8, wherein a grid is arranged in the lower part of the upper cylinder and is suitable to carry out a further filtering of the fumes which pass through it.

11. The system as in claim 10, wherein the grid is provided with its own cooling means with the circulation of cooling fluid.

12. An electric arc system to reduce the losses of fine materials and powders from an electric arc furnace comprising:

said electric arc furnace having a lower hearth suitable to contain a bath of metal material being melted, a substantially cylindrical chamber arranged above the hearth, at least one electrode arranged in a central zone of the chamber, a roof arranged to cover the chamber and provided with at least one aperture through which the fumes produced by the bath can exit, and an aspiration system comprising:

a first aspiration sub-system arranged inside the chamber, and at least another discharge sub-system arranged in correspondence with the roof, and wherein the first aspiration sub-system comprises a coil of cooling pipes arranged helically to have spirals so as to define, in a vertical direction, empty zones between the spirals of pipes, the coil of cooling pipes being distanced from the cylindrical wall of the chamber to define a peripheral interspace between the coil and the cylindrical wall of the chamber through which the fumes can ascend towards the roof according to at least an ascensional, rotatory vortex.

13. The system as in claim 12, wherein the coil of pipes is arranged offset with respect to the chamber, so that the width of the peripheral interspace is variable in a radial direction.

14. The system as in claim 12, wherein the coil of pipes is arranged substantially in a truncated cone, with the tapered part facing upwards, so that the width of the peripheral interspace is variable in a horizontal direction.

15. The system as in claim 14, wherein the angle (5) of taper of the coil of pipes is about 5–10°.

16. The system as in claim 12, wherein the empty zones allow the horizontal or substantially horizontal passage of the fumes from the center of the central chamber towards the peripheral interspace.

17. The system as in claim 16, wherein the distance in a vertical direction between the pipes inside the central chamber is between 70 and 120 mm, to allow the fumes to pass at a speed (W1) of between about 1 and 15 meters per second.

18. The system as in claim 12, wherein the width of the interspace is a function of the inner diameter ($D_1$) of the chamber and of the outer diameter ($D_2$) of the coil of pipes and wherein the ratio between the inner diameter ($D_1$) and the outer diameter ($D_2$) is between about 1.1 and 1.6 ($D_1$=1.1–1.6×$D_2$).

19. The system as in claim 1, wherein the other discharge sub-system comprises an upper cylinder arranged on the upper part of the roof, in a peripheral position, and connected tangentially with the aperture to induce a helical movement in the inner volume.

20. The system as in claim 19, wherein the upper cylinder has walls provided with cooling means.

21. The system as in claim 19, wherein a grid is arranged in the lower part of the upper cylinder and is suitable to carry out a further filtering of the fumes which pass through it.

22. The system as in claim 21, wherein the grid is provided with its own cooling means with the circulation of cooling fluid.

* * * * *